US005657993A

United States Patent [19]

Merlino et al.

[11] Patent Number: 5,657,993

[45] Date of Patent: Aug. 19, 1997

[54] METHOD OF PLAYING A POKER-TYPE WAGERING GAME

[76] Inventors: Nicholas Merlino; Shawn Jiampetti, both of 107 Sixth St. North, Brigantine, N.J. 08203

[21] Appl. No.: 733,143

[22] Filed: Oct. 17, 1996

[51] Int. Cl.[6] ..... A63F 1/00

[52] U.S. Cl. ..... 273/292

[58] Field of Search ..... 273/292, 309, 273/274

[56] References Cited

U.S. PATENT DOCUMENTS

| | | | |
|---|---|---|---|
| 4,648,604 | 3/1987 | Horan | 273/292 |
| 4,836,553 | 6/1989 | Suttle et al. | 273/292 |
| 5,067,724 | 11/1991 | Rinkavage | 273/292 |
| 5,265,882 | 11/1993 | Malek | 273/292 |
| 5,288,081 | 2/1994 | Breeding | 273/292 |
| 5,322,295 | 6/1994 | Cabot et al. | 273/292 |
| 5,382,025 | 1/1995 | Sklansky et al. | 273/292 |
| 5,411,268 | 5/1995 | Nelson et al. | 273/292 |
| 5,486,005 | 1/1996 | Neal | 273/292 |
| 5,489,101 | 2/1996 | Moody | 273/292 |
| 5,531,448 | 7/1996 | Moody | 273/292 |

OTHER PUBLICATIONS

Scarne's Encyclopedia of Games by John Scarne, "Criss Cross", Harper & Row Publishers, pp. 19, 25 and 26, 1973.

*Primary Examiner*—Benjamin H. Layno

*Attorney, Agent, or Firm*—Norman E. Lehrer

[57] ABSTRACT

A method of playing a poker-type wagering game on top of a table layout having first and second player locations, a plurality of betting areas associated with each of the player locations and a community card area. The method includes a first player placing a wager on top of each of the betting areas associated with the first player location. A second player places a wager on top of each of the betting areas associated with the second player location. Each player receives two playing cards. A number of community cards are dealt face down in the community card area in a predetermined pattern. The number of community cards corresponds to the number of betting areas in one of the player locations. The faces of community cards are exposed in succession. Each time a community card is exposed, each of the players can either fold wherein the folding player loses a number of wagers which corresponds to the number of community cards exposed or the players can leave all of the wagers on the corresponding betting areas until all of community cards are exposed. Once all of the community cards are exposed, each of the players combines his or her pair of cards with three of the community cards to form a completed stud poker hand. The player with the highest ranking hand wins all of the wages.

12 Claims, 3 Drawing Sheets

METHOD OF PLAYING A POKER-TYPE WAGERING GAME

BACKGROUND OF THE INVENTION

The present invention is directed toward a method of playing a poker-type wagering game. More particularly, it relates to such a game which includes a standard deck of 52 playing cards wherein players and/or dealers form a five card stud poker hand by using two individually dealt cards and three out of a possible five community cards which are dealt in a predetermined pattern.

Poker type card games have been played for many years. Such card games are often played in gaming casinos. There are various forms of poker that are played. Examples of different methods of playing poker are disclosed in U.S. Pat. Nos. 4,648,604, 4,836,553, 5,067,724, 5,265,882, 5,322,295, and 5,489,101.

It is an object of the present invention to provide a new method of playing poker which will be widely accepted and easily understood.

It is a further object to provide a new method of playing poker wherein a player can play against another player or against a gaming establishment.

It is yet another object of the invention to provide a new method of playing poker that allows a relatively large number of players to play at one time.

SUMMARY OF THE INVENTION

In accordance with the illustrative embodiments, demonstrating features and advantages of the present invention, there is provided a method of playing a poker-type wagering game on top of a table layout having first and second player locations, five betting areas associated with each of the player locations and a community card area. The method includes a first player placing a wager on top of each of the five betting areas associated with the first player location. A second player places a wager on top of each of the five betting areas associated with the second player location. A first pair of playing cards are dealt face down to the first player on top of the first player location. A second pair of playing cards is dealt face down to the second player on top of the second player location. Five community cards are then dealt face down in the community card area in a predetermined pattern.

The face of one of the community cards is exposed. Each player then examines his or her pair of playing cards. Each player can either fold wherein the folding player loses one of the wagers placed on a betting area to the other of the players and the poker-type wagering game is terminated or each of the players leaves all of the wagers on the corresponding betting areas.

The face of another one of the community cards is exposed and each player can either fold wherein the folding player loses two wagers placed on two corresponding betting areas to the other of the players and the game is terminated or each of the players leaves all of the wagers on the corresponding betting areas and the game continues.

The faces of the remaining community cards are individually exposed and each time the player can fold and lose the number of wagers, which corresponds to the number of community cards exposed, to the other player or the players can leave all of the wagers on the betting areas. Once all of the community cards are exposed, each of the players combines his or her pair of cards with three of the community cards to form a completed stud poker hand. The player with the highest ranking hand wins all of the wagers.

Other objects, features and advantages of the invention will be readily apparent from the following detailed description of preferred embodiments thereof taken in conjunction with the drawings.

BRIEF DESCRIPTION OF THE DRAWINGS

For the purpose of illustrating the invention, there is shown in the accompanying drawings forms which are presently preferred; it being understood that the invention is not intended to be limited to the precise arrangements and instrumentalities shown.

DETAILED DESCRIPTION OF THE PREFERRED EMBODIMENT

The present invention comprises a method for playing a poker-type wagering game which utilizes a standard deck of 52 playing cards. While the present poker-type wagering game will be described for use at a gaming table with one or more players, it should be noted that the game can be adapted to be played on a board game or a computer type video gaming machine.

Figure 1:
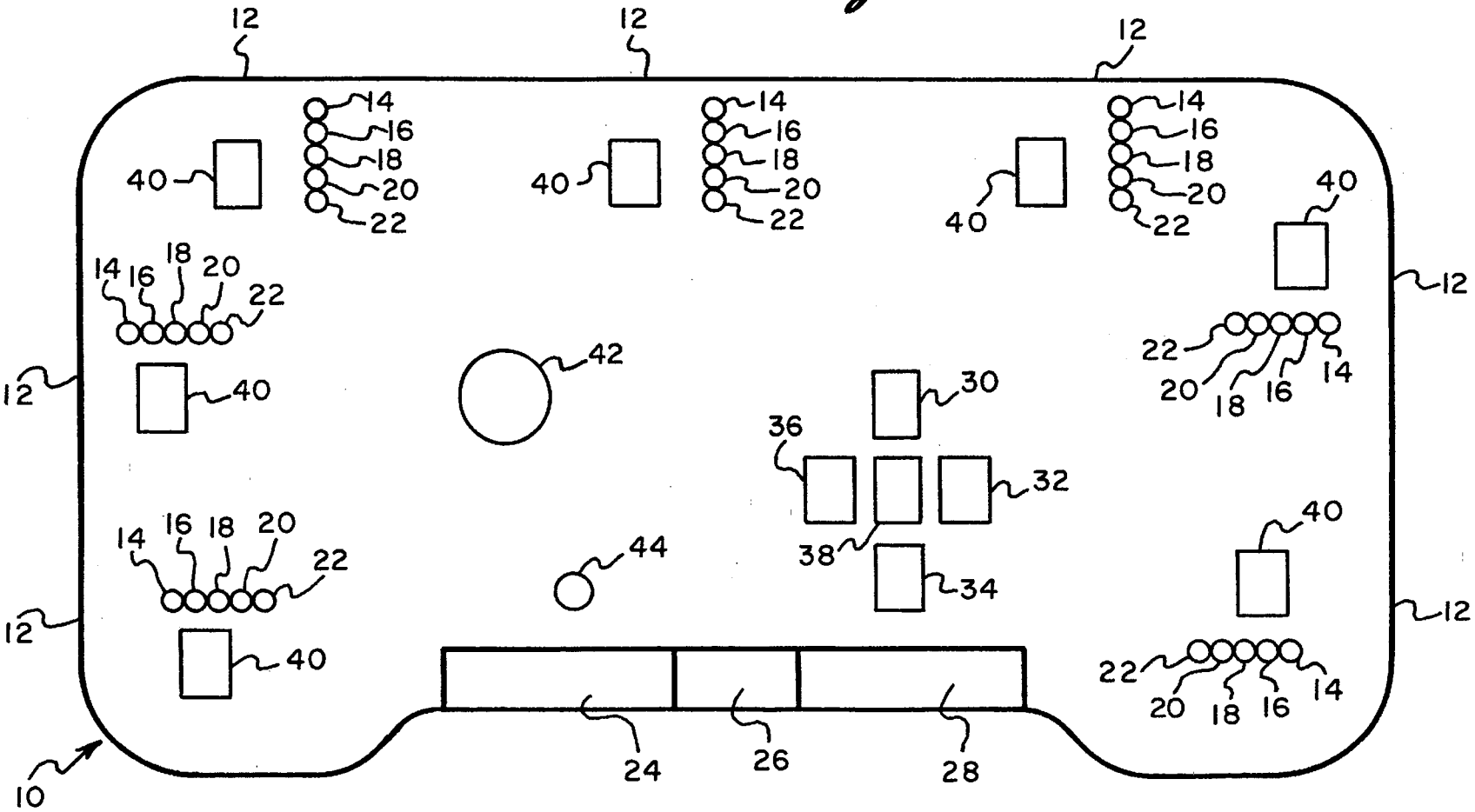
FIG. 1 is a schematic diagram of a table layout utilized in playing a poker room version of the present invention.

Referring to FIG. 1, a table layout 10 for a poker room version of the present invention is schematically shown. The layout would typically be mounted on top of a conventional type gaming table (not shown). A plurality of playing locations 12 are provided along the periphery of the table. In the preferred embodiment, there are 7 playing locations, however the number of playing locations can be varied. Each of the playing locations has a plurality of betting circles 14, 16, 18, 20, and 22 associated therewith into which a player places five bets of equal amounts. Each player is obligated to wager at least one bet regardless of his or her hand as more fully described below.

A dealer's station 24 is provided adjacent a discard rack 26 and a chip rack 28. The discard rack is utilized to hold cards that have already been used, which will be more fully explained herein. The chip rack 28 is of conventional design and is utilized to store poker chips or the like. Chips are collected and placed in the chip rack when a player loses a hand to the "house" and chips are paid out when a player wins a hand.

Conventional playing cards are used to play the poker-type wagering game of the present invention. One deck of 52 cards is preferably employed and the same is reshuffled after each round is played. However, two or more decks could be utilized.

A round is started by each player placing five bets of equal amounts in the betting circles 14, 16, 18, 20 and 22. Thereafter, a dealer deals two cards face down from left to right to all of the players. Once the last player receives his or her two cards, five additional community cards are placed face down on the table layout 10 in a criss-cross pattern on top of areas 30, 32, 34, 36 and 38. The community cards are preferably first dealt from top to bottom on the criss-cross pattern. In other words, a card is first dealt face down on area 30, then on area 38, and then on area 34. The forth community card is then dealt on area 36 which is located to the left of the center area 38. Lastly, a fifth community card is dealt on area 32. In making up a complete poker hand, each of the players will utilize his or her two cards and three of the community cards as more fully explained below. It should be noted that the community cards can be dealt in different orders and can be arranged in different patterns such as a T-shaped pattern or a L-shaped pattern.

Once the last of the community cards is dealt, the remaining cards are discarded. Thereafter, the center community card located on area 38 will be exposed by the dealer. The players will then be allowed to view the two cards which were individually dealt to them. After the two cards have been viewed, the player has two options. He or she can fold immediately and forfeit only the contract or initial bet which was placed on betting circle 14. Alternatively, a player who wishes to continue playing leaves all five of his or her bets in the betting circles 14, 16, 18, 20 and 22. Each of the remaining players also has the option of raising his or her bet by placing additional poker chips in area 40 located adjacent his or her betting circles on the table layout 10. Raises are allowed to be made after each new exposure of a community card.

The bets of all of the players who have folded are collected in a pot located in area 42 of the table layout 10. Thereafter, the top community card, which covers area 30, is exposed by the dealer. The remaining players have the same options as above. That is, if a player decides to fold at this time he or she will forfeit two bets, one for each community card exposed. On the other hand, if a player decides to continue all five bets are left in the betting circles.

The right community card which covers area 32 is then exposed and the remaining players once again decide whether to fold or continue. If a player folds at this time, three bets are forfeited. The bottom community card which covers area 34 is thereafter exposed and the remaining players can fold and forfeit four of the bets or they can continue to play. The cards of the players who folded are once again collected and placed in the discard rack 26. Finally, the left community card which covers area 36 is exposed. It should be noted that the order in which the community cards are exposed can be readily changed.

Once all of the community cards are exposed, each of the players determines his or her completed stud poker hand by combining the two cards which were originally dealt to him or her with three of the community cards. However, the community cards cannot be selected at random. Rather, the three cards must be selected from top to bottom, i.e. cards which are located atop areas 30, 38, and 34, or from left to right, i.e. cards which are located atop areas 36, 38, and 32.

Thereafter, the dealer determines who has the highest hand out of the remaining players. The highest hand of all of the players wins. Accordingly, the players play against themselves and not against the dealer. The ranking of hands is determined by the conventional rules of poker which are known in the art. Specifically, the hands are ranked in the following order with the royal flush being the highest winning hand: royal flush, straight flush, four of a kind, full house, flush, straight, three of a kind, two pair, and one pair.

As in a conventional cardroom poker game, the dealer collects a house rake in area 44 of the table layout 10. The house rake may be a percentage of each player's ante, each player's bets, or the total amount collected in the pot. Once the house rake is taken from the pot, the player with the highest hand collects his or her winnings. It is also contemplated that the dealer or house may pay out a bonus straight from the house bank to any player who has a high ranking hand. For example, a bonus could be paid to any player who has a royal straight flush.

Figure 2:
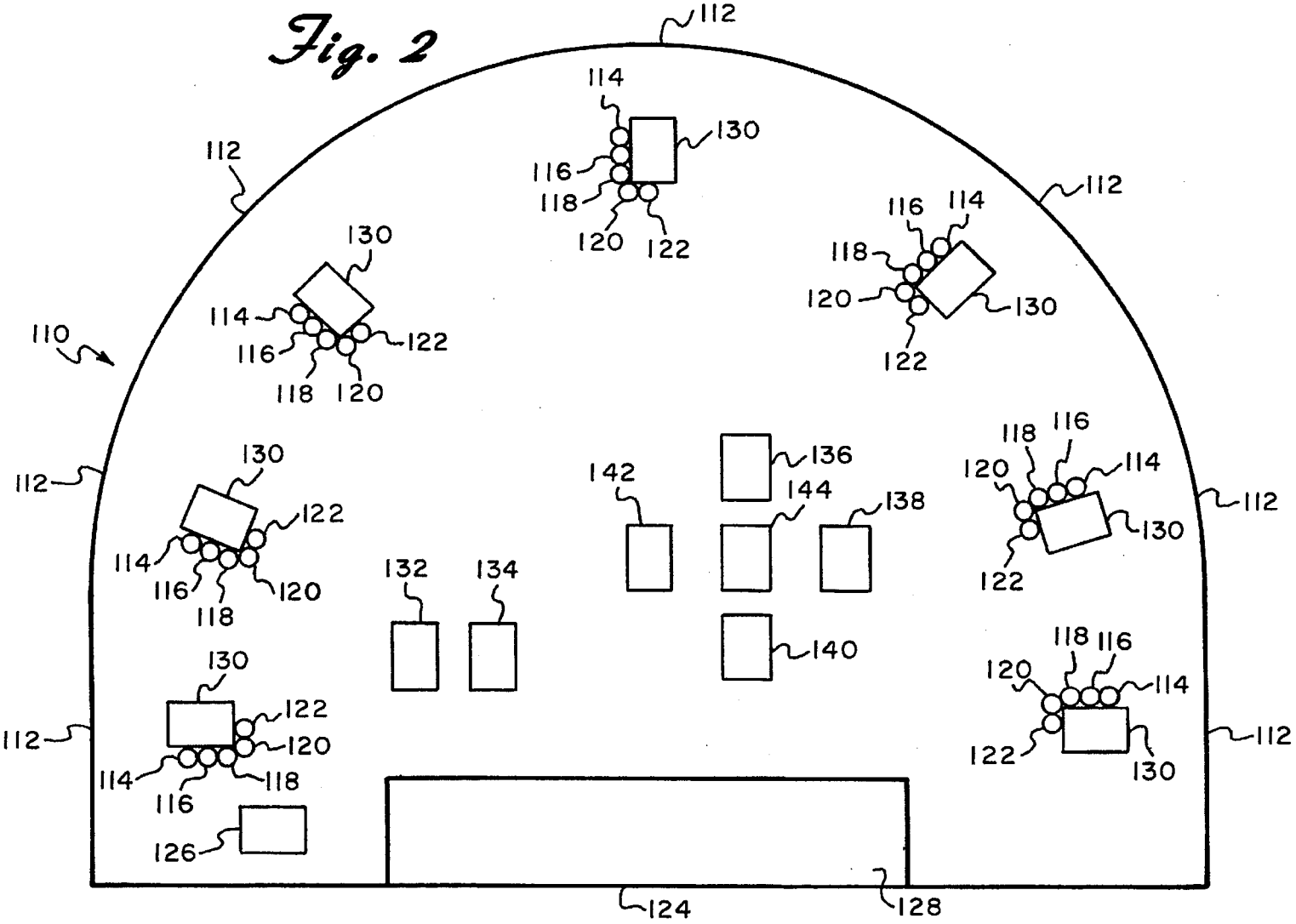
FIG. 2 is a schematic diagram of a modified table layout utilized in playing a casino version of the present invention.

Referring to FIG. 2, a table layout 110 for a casino version of the present invention is schematically shown. The casino version is played in a somewhat similar manner to the poker version described with some differences which are discussed infra. Once again, the layout would typically be mounted on top of a conventional type gaming table. A plurality of playing locations 112 are provided along the periphery of the table. Each of the playing locations has a plurality of betting circles 114, 116, 118, 120, and 122 associated therewith into which a player places five bets of equal amounts.

A dealer's station 124 is provided adjacent a discard rack 126 and a chip rack 128. A round is started by each player placing five bets in the betting circles 114, 116, 118, 120 and 122. The first bet which is placed in betting circle 114 is the contract bet. Bets two through five, which are placed in circles 116, 118, 120 and 122, must be of equal amounts. The contract bet can be up to twice the amount of any of the individual bets two through five (for example, if bets two through five are $5.00 each then the contract bet can be anywhere from $5.00 to $10.00).

Thereafter, the dealer deals two cards face down from left to right to all of the players. Each of the players' cards are placed on top of an area 130. Thereafter, the dealer deals himself or herself two cards on top of areas 132 and 134 on the table layout 110. Once the dealer receives his or her two cards, five additional community cards are placed face down on the table layout 110 in a criss-cross pattern on top of areas 136, 138, 140, 142 and 144. The community cards are preferably first dealt from top to bottom on the criss-cross pattern. In other words, a card is first dealt face down on area 136, then on area 144, and then on area 140. The forth community card is then dealt on area 142 which is located to the left of the center area 144. Lastly, a fifth community card is dealt on area 138. In making up a complete poker hand, each of the players will utilize his or her two cards and three of the community cards as more fully explained below. Again, it should be noted that the community cards can be dealt in different orders and can be arranged in different patterns such as a T-shaped pattern or a L-shaped pattern.

Once the last of the community cards is dealt, the remaining cards are discarded and placed in discard rack 126. Thereafter, the center community card located on area 144 is exposed by the dealer. The players will then be allowed to view the two cards which were individually dealt to them. The players, of course, will not be allowed to reveal the cards to anyone else. After the two cards have been viewed, the player has two options. He or she can fold immediately and forfeit only the contract or initial bet which was placed on betting circle 114. Alternatively, a player who wishes to continue playing leaves all five of his or her bets in the betting circles 114, 116, 118, 120 and 122.

The bets of all of the players who have folded are collected and placed into the chip rack 128 which belongs to the house. The cards of the players who folded are also collected and placed in the discard rack 126. Thereafter, the top community card, which covers area 136, is exposed by the dealer. The remaining players have the same options as above. That is, if a player decides to fold at this time he or she will forfeit two bets, one for each community card exposed. On the other hand, if a player decides to continue all five bets are left in the betting circles.

The right community card which covers area 138 is then exposed and the remaining players once again decide whether to fold or continue. If a player folds at this time, three bets are forfeited. The bottom community card which covers area 140 is thereafter exposed and the remaining players can fold and forfeit four of the bets or they can continue to play. The cards of the players who folded are once again collected and placed in the discard rack 126. Finally, the left community card which covers area 142 is exposed.

Once all of the community cards are exposed, each of the players determines his or her completed stud poker hand by combining the two cards which were originally dealt to him or her with three of the community cards. As with the poker version, the three cards must be selected either from top to bottom or left to right. The dealer then selects the three community cards he or she desires to use to complete his or her five card stud poker hand.

The dealer then examines the hands of each of the remaining players one at a time to determine if that player has one or lost. If the dealer has a better hand than the player, the players bets are collected and are placed in the chip rack 128. If the player has a better hand than the dealer, the player will be paid according to the following preferred payout schedule:

| Type of Hand | Payout Odds |
|---|---|
| Royal Flush | 500-to-1 |
| Straight Flush | 100-to-1 |
| Four of a kind | 40-to-1 |
| Flush | 7-to-1 |
| Straight | 5-to-1 |
| Three of a kind | 3-to-1 |
| Two pair | 2-to-1 |
| One pair | 1-to-1 |

It should be noted that the payout odds listed above can be changed according to the desires of the house. After the dealer has paid the winning players, all of the cards are collected and the dealer shuffles the same so that the next game can be played.

The casino version can also include a qualification requirement for the dealer. More specifically, the game would be played in the same manner discussed above except that after the final community card is exposed, the dealer will determine if he holds a predetermined qualifying hand. If the dealer does not hold such a qualifying hand, all of the remaining players will be paid 1-to-1 on their contract bets only. The remaining bets will be returned to the players. If, on the other hand, the dealer does hold a qualifying hand, the game proceeds in the same manner discussed above.

Figure 3:
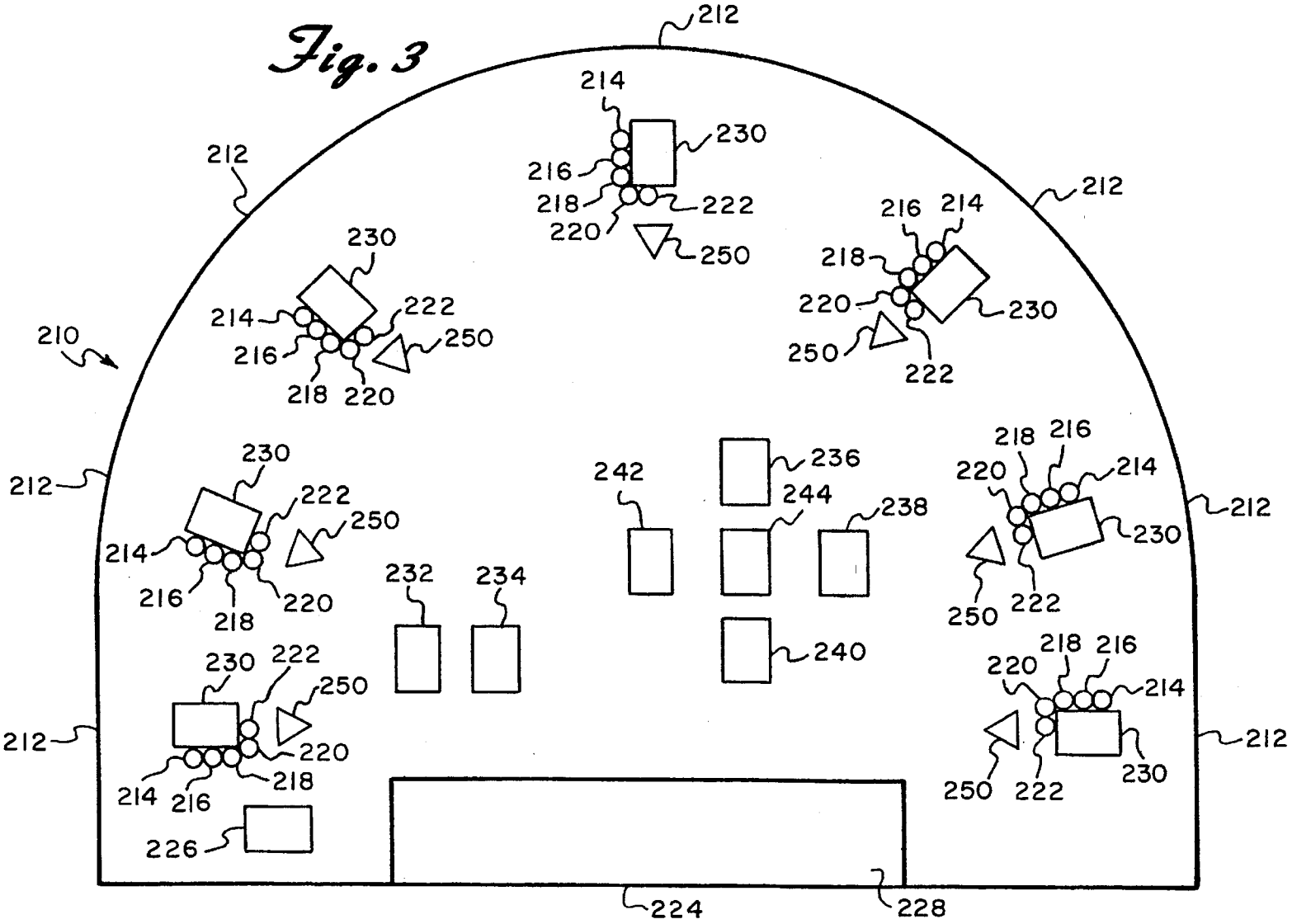
FIG. 3 is a schematic diagram of yet another modified table layout utilized in playing an alternate casino version of the present invention.

Referring to FIG. 3, a table layout 210 for an alternate casino version of the present invention is schematically shown. Again, the table layout is adapted to be placed on top of a conventional gaming table. A plurality of playing locations 212 are provided along the periphery of the table. Each of the playing locations has a plurality of betting circles 214, 216, 218, 220, and 222 associated therewith into which a player places five bets of equal amounts.

A dealer's station 224 is provided adjacent a discard rack 226 and a chip rack 228. A round is started by each player placing five bets in the betting circles 214, 216, 218, 220 and 222. The first bet which is placed in betting circle 214 is the contract bet. Bets two through five, which are placed in circles 216, 218, 220 and 222, must be of equal amounts. The contract bet can be up to twice the amount of any of the individual bets two through five.

Thereafter, the dealer deals two cards face down from left to right to all of the players. Each of the players' cards are placed on top of an area 230. Thereafter, the dealer deals himself or herself two cards on top of areas 232 and 234 on the table layout 210. Once the dealer receives his or her two cards, five additional community cards are placed face down on the table layout 210 in a criss-cross pattern on top of areas 236, 238, 240, 242 and 244. The community cards are preferably first dealt from top to bottom on the criss-cross pattern in the manner discussed above.

Once the last of the community cards is dealt, the remaining cards are discarded and placed in discard rack 226. The players are then allowed to view the two cards which were individually dealt to them. After two cards have been viewed, each player has three options. He or she can fold immediately and forfeit only the contract or initial bet which was placed on betting circle 214. Alternatively, a player who wishes to continue playing leaves all five of his or her bets in the betting circles 214, 216, 218, 220 and 222. Yet another option is for each player to choose to play a three card poker-type wagering game which will be discussed infra. If the player chooses the second option, i.e. the five card option, the game proceeds in the same manner as the original casino version discussed above.

However, if one or more players chooses the three card option the game proceeds for those players only in the following manner. Each three card player must move his or her contract bet, which is located on betting circle 214, and one of the bets located on the remaining betting circles to area 250 on the table layout 210. The remaining bets will be returned to the each of the three card players. Each of the three card players completes his or her hand by combining the two cards which were initially dealt to the player with the center community card which is placed on top of area 244. The three card players will have a winning hand if their three cards make a straight flush, three of a kind, a straight, a flush, or any pair. The payout odds are preferably as follows:

| Type of Hand | Payout Odds |
|---|---|
| Straight Flush | 20-to-1 |
| Three of a kind | 15-to-1 |
| Straight | 4-to-1 |
| Flush | 2-to-1 |
| One pair | 1-to-1 |

Accordingly, the three card players do not play against the house. Rather, in order for one of the three card players to win, he or she has to have one of the winning hands enumerated above. If the three card player does not have a winning hand, he or she loses the bet located in area 250 on the table layout 210.

The present invention may be embodied in other specific forms without departing from the spirit or essential attributes thereof and accordingly reference should be made to the appended claims rather than to the foregoing specification as indicating the scope of the invention.

What is claimed is:

1. A method of playing a poker-type wagering game on top of a table layout having first and second player locations, a number of betting areas associated with each of said player locations and a community card area, said method comprising the steps of:

(a) a first player placing a wager on top of each of said betting areas associated with said first player location;

(b) a second player placing a wager on top of each of said betting areas associated with said second player location;

(c) dealing a first pair of playing cards face down to said first player;

(d) dealing a second pair of playing cards face down to said second player;

(e) dealing a number of community cards face down on said community card area in a predetermined pattern, the number of community cards being equivalent to the number of betting areas associated with one of said player locations;

(f) exposing the face of one of said community cards;

(g) allowing said first player to examine the faces of said first pair of playing cards;

(h) allowing said second player to examine the faces of said second pair of playing cards;

(i) one of said players either folding in which case said folding player loses the number of wagers which corresponds to the number of community cards exposed or said one of said players leaving all of said wagers on said corresponding betting areas;

(j) repeating steps (f) and (i) until all of said community cards are exposed;

(k) said first player combining said first pair of playing cards with three of said community cards to form a first stud poker hand;

(l) said second player combining said second pair of playing cards with three of said community cards to form a second stud poker hand, and (m) said second player receiving said wagers on said betting circles on said first player location if said second poker hand is of a higher rank than said first poker hand, said first player receiving said wagers on said betting circles on said second player location if said first poker hand is of a higher rank than said second poker hand.

2. The method of claim 1 wherein said predetermined pattern is cross shaped so that there is a middle community card, an upper community card, a lower community card, a left community card and a right community card.

3. The method of claim 2 wherein said first and second players combine said first and second pairs of cards with either said middle, upper and lower community cards, or said middle, left and right community cards in steps (k) and (l), respectively, of claim 1.

4. The method of claim 1 further including the step of allowing each of said players to place additional wagers in an area on said table layout each time a community card is exposed.

5. The method of claim 1 wherein there are five betting areas associated with each of said player locations.

6. A method of playing a poker-type wagering game on top of a table layout having a player location, a number of betting areas associated with said player location, and a community card area, said method comprising the steps of:

(a) a player placing a wager on top of each of said betting areas;

(b) dealing a first pair of playing cards face down to said player;

(c) dealing a second pair of playing cards face down to a dealer;

(d) dealing a number of community cards face down on said community card area in a predetermined area, the number of community cards being equivalent to the number of betting areas;

(e) exposing the face of one of said community cards;

(f) allowing said player to examine the faces of said first pair of playing cards;

(g) said player either folding in which case said folding player loses the number of wagers which corresponds to the number of community cards exposed or said player leaving all of said wagers on said corresponding betting areas;

(h) repeating steps (e) and (g) until all of said community cards are exposed;

(i) said player combining said first pair of playing cards with three of said community cards to form a first stud poker hand;

(j) said dealer combining said second pair of playing cards with three of said community cards to form a second stud poker hand, and (k) said player losing all of said wagers on said betting circles on said first player location if said second poker hand has a higher rank than said first poker hand, said player receiving a predetermined amount of wagers based on the ranking of said first poker hand if said first poker hand has a higher rank than said second poker hand.

7. The method of claim 6 wherein said predetermined pattern is cross shaped so that there is a middle community card, an upper community card, a lower community card, a left community card and a right community card.

8. The method of claim 6 wherein there are five betting areas.

9. The method of claim 6 further including the steps of terminating said game, awarding a wager equivalent to one of said wagers on one of said betting circles to said player, and returning all of said wagers on said betting circles to said player if said second poker hand of step (j) of claim 6 has a rank below a predetermined value.

10. A method of playing a poker-type wagering game on top of a table layout having a player location, a number of betting areas associated with said player location, and a community card area, said method comprising the steps of:

(a) a player placing a wager on top of each of said betting areas;

(b) dealing a first pair of playing cards face down to said player;

(c) dealing a second pair of playing cards face down to a dealer;

(d) dealing a number of community cards face down on said community card area in a predetermined area, the number of community cards being equivalent to the number of betting areas;

(e) exposing the face of one of said community cards;

(f) allowing said player to examine the faces of said first pair of playing cards;

(g) said player either folding in which case said folding player loses only one of said wagers placed on said betting circles or said player retrieving all but two of said wagers on said betting circles;

(h) said player combining said first pair of playing cards with said exposed community card to form a three card poker hand, and (i) said player losing said two wagers if said three card poker hand is below a predetermined rank, said player receiving a predetermined amount of wagers based on the ranking of said three card poker hand if said three card poker hand is above a predetermined rank.

11. The method of claim 10 wherein said predetermined pattern is cross shaped so that there is a middle community card, an upper community card, a lower community card, a left community card and a right community card.

12. The method of claim 11 wherein said community card which is exposed in step (e) of claim 10 is said middle community card.

* * * * *